US006694910B1

(12) United States Patent
Sharapov

(10) Patent No.: US 6,694,910 B1
(45) Date of Patent: Feb. 24, 2004

(54) FLOATING ISLAND APPARATUS AND METHOD OF CONTROL

(76) Inventor: Sergei Vyacheslavovich Sharapov, 110 Pacific Ave., #358, San Francisco, CA (US) 94111

( * ) Notice: Subject to any disclaimer, the term of this patent is extended or adjusted under 35 U.S.C. 154(b) by 0 days.

(21) Appl. No.: 09/623,762

(22) PCT Filed: Mar. 11, 1998

(86) PCT No.: PCT/RU98/00069

§ 371 (c)(1),
(2), (4) Date: Sep. 8, 2000

(87) PCT Pub. No.: WO99/46164

PCT Pub. Date: Sep. 16, 1999

(51) Int. Cl.[7] ..... B63B 35/44
(52) U.S. Cl. ..... 114/264; 114/39.21
(58) Field of Search ..... 114/311, 264, 114/39.21, 77 R; 440/113

(56) References Cited

U.S. PATENT DOCUMENTS

| | | | | | |
|---|---|---|---|---|---|
| 3,708,991 | A | * | 1/1973 | Barkley | |
| 3,878,806 | A | * | 4/1975 | Garcia | 114/77 R |
| 4,313,059 | A | * | 1/1982 | Howard | 290/54 |
| 4,473,026 | A | * | 9/1984 | Bass | 114/255 |
| 5,878,682 | A | * | 3/1999 | Hulbig et al. | 114/56 |

FOREIGN PATENT DOCUMENTS

| | | | |
|---|---|---|---|
| SU | 1113303 | * | 9/1984 |

* cited by examiner

*Primary Examiner*—Sherman Basinger
(74) *Attorney, Agent, or Firm*—Richard E. Backus

(57) ABSTRACT

A floating island apparatus and method of operation in which a floating main body is connected by a cable system with an underwater sail. The cable system is operated to adjust the sail orientation in an underwater current to regulate the magnitude and vector of forces on the sail. This controls the floating island by enabling the forces on the sail to either move or hold stable the main body.

16 Claims, 4 Drawing Sheets

FLOATING ISLAND APPARATUS AND METHOD OF CONTROL

BACKGROUND OF THE INVENTION

1. Field of the Invention

This invention belongs to the field of oceanography and hydrology and, in particular, to floating islands and method for their control.

2. Description of the Related Art

It is known that unique weather conditions characterize the equatorial section of the Pacific Ocean: the virtual absence of storms, a significant prevalence of sunny days in the year, a constant wind direction and a high background temperature. All of these factors are favorable to the construction of, for example, floating islands, on which people can work or take vacations.

In 1951, the Cromwell equatorial current was discovered in the Pacific Ocean. It measures up to 250 m across, stretches over more than 300 km, and is located at a depth of 50–100 m. Later, such currents were discovered in the Atlantic Ocean and the Indian Ocean. These currents have speeds of up to 150c/s and are aligned along the equator, but at an angle of 180° to the equatorial surface current (see N. K. Haichenko, Sistema Ekvatorialnikh Protivotechenii v Okeane [The Oceanic System of Equatorial Countercurrents], pub. Gidrometeoizdat, Leningrad, 1974, 158 p.; V. A. Burkov, Obshaya Tsirkulyatsiya Mirovogo Okeana [General Circulation in the World Ocean], pub. Gidrometeoizdat, Leningrad, 1980, 156 p.).

A floating island is known to have been built in the form of a flower, and to contain an independent power source to maintain life on the island (GB, A, 2097340). However, this floating island is intended only for coastal use, to be deployed in calm, enclosed bays; it cannot be used in the open sea.

Another floating island is intended for seaside resorts, and consists of foam plastic sheets linked together (DE, A, 3336352). However, this island is difficult to control and can only drift along the surface current or be tugged by another vessel.

In addition, neither of the two above islands utilizes the energy of underwater currents for the purpose of movement. The most similar proposal to this idea is a drifting station for oceanographic research, consisting of a buoy and a large container, as well as an underwater sail, connected to the buoy with a wire cable. A load is attached to the underwater sail, which has a fastening junction (SU, A, 1113303). The structure of the station described here ensures that it drifts with a velocity equal to that of the surface current, and does not allow for alteration of the direction of travel, or for any movement against the current, or for maintaining a position at any given coordinates. The sail of this apparatus is intended to guarantee that the buoy drifts with a speed equal to that of the surrounding water, in effect to reduce the magnitude of drift due to the wind.

SUMMARY OF THE INVENTION

This invention is based upon an attempt to create a floating island with a control system. It utilizes the energy of an underwater countercurrent in the water environment, and an underwater sail is connected to the main body. In this way the control method makes it possible for the floating island to move freely in any chosen direction, or hold a position with specified coordinates within the boundaries of the current mentioned above.

BRIEF DESCRIPTION OF THE DRAWINGS

FIG. 2(*b*) is a top plan view of the floating island of FIG. 2(*a*).

FIG. 4(*b*) is a top plan view of the floating island of FIG. 4(*a*) shown in a moved

DESCRIPTION OF THE PREFERRED EMBODIMENTS

Figure 1:
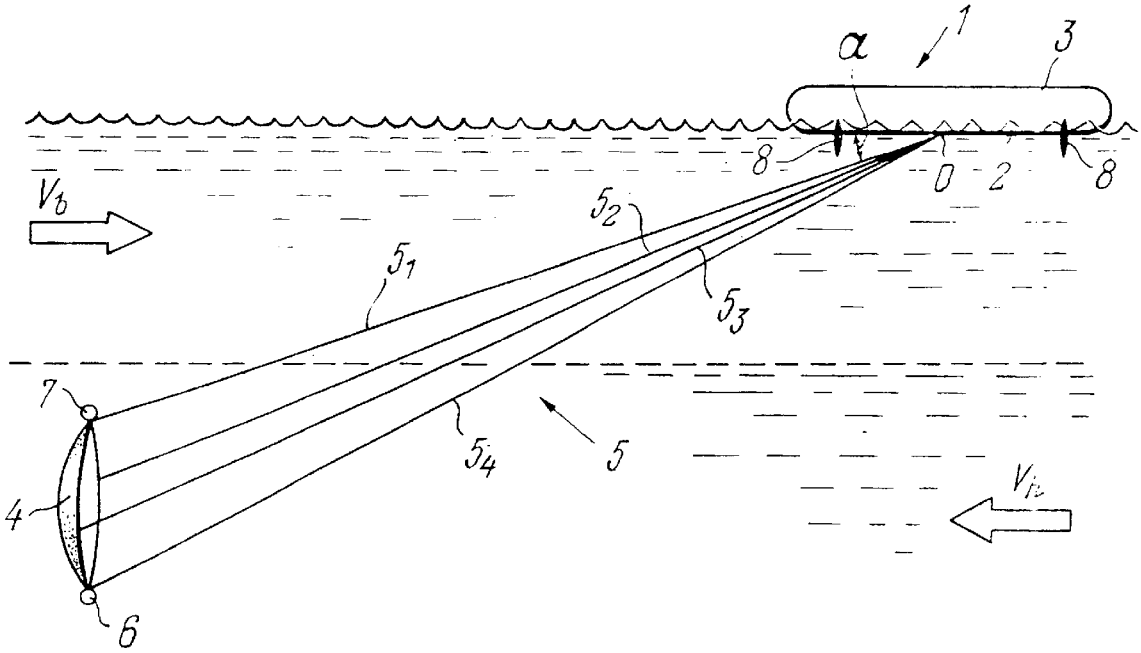
FIG. 1 portrays the general view of the floating island with one underwater sail, as in the invention design.

The floating island apparatus in its broadest form comprises a body, made of underwater and surface sections with positive buoyancy, and an underwater sail connected to the underwater part of the body using a connecting junction and fitted with a fixed load. The connecting junction comprises a system of wire cables, the lower ends of which are connected to points on the perimeter of the underwater sail. The upper ends are connected to the surface section of the body, with the possibility of reducing the length of at least one of the cables. The number of cables in each connecting junction can be between 1 and 20.

The body of the floating island is comprised of modules with positive buoyancy and connected to each other. The upper ends of the connecting junction cables are connected to at least one of the modules, and the floating island comprises at least one additional underwater sail with an individual connecting junction, for it to be connected to at least one of the modules.

The connecting junction can be constructed in the form of a system of cables, the length of at least one of which can be regulated, allowing the underwater sail's angle of incidence to be altered both in the horizontal and vertical planes. The depth to which the underwater sail is submerged can also be regulated. This makes it possible to control the underwater sail, submerging it to the depth of the surface countercurrent, and thus allowing either the free movement of the floating island in any chosen direction, or allowing a position at specified coordinates to be held. To do this, the island is equipped with devices to regulate the length of the connecting junction cables and with an automated system for their control.

Depending on the size of the main body of the floating island, it can contain at least one additional underwater sail with an individual connecting junction to connect it to the underwater section of the body. Also, at least one of the underwater sails can be made of interconnected parts, where the total number k of underwater sails and/or their interconnected parts are in accordance with the formula:

$$1 \leqq k \leqq 10^{10},$$

where the minimum area $S_1$ of each section of the underwater sail is determined in relation to its total area $S_2$ within the limits of the formula:

$$1{,}001 < (S_1 + S_2) : S_2 \leqq 2.$$

Depending on the chosen application of the floating island, it can <A) comprise modules with positive buoyancy fixed together, the number of which will be determined within the limits of the formula:

$$2 \leqq m \leqq 10^{10}.$$

Drop keels can be installed to smoothly alter the magnitude, direction and point of application of the force produced by the surface water current, more specifically by lateral and frontal resistance on the underwater part of the body. For this purpose, the keels are designed such that they can be rotated about their vertical axis.

In order to provide a more stable vertical position, the underwater sail is fitted with at least one float, which preferably is fixed in the upper part of the sail. To augment the ergonomic qualities of the island where it is to be used as a place where people can live, take vacations and work, the floating island can be equipped with: a compass navigation system; at least one energy source; a set of solar panels or a sea water desalination apparatus.

Where the underwater sail is to be fitted with at least one complete power machine unit, the floating island with positive buoyancy will be capable of independently reaching a prescribed geographical point. The underwater sail can take the shape, for example, of a circle, a rectangle, a torus, a triangle, a polygon, a trapezoid or an ellipse, and is to be made from a material which ensures a long service life and withstands significant loads. The following could serve to fulfill this purpose: foam concrete, concrete, stainless steel or synthetic materials.

The task set is also solved by including the following in the control system for a floating island with underwater sail: the underwater sail is affected by water flows which create a tractive force, which is in turn passed on to the body of the floating island. In the design, the resultant tractive force is regulated by the underwater sail's depth of submersion, by changing the angle of incidence between the resultant vector of tractive force, the horizontal water surface and the angle of rotation of the underwater sail in the vertical plane. The direction of movement of the floating island is regulated by altering the sail's angle of incidence in the horizontal plane, and altering the angle between the resultant vector of water pressure forces on the underwater sail and the projected vector of tractive force of the connecting junction onto the horizontal plane.

In the invention, the floating island's resultant tractive force is regulated by altering the angle cc between the resultant tractive force vector and the horizontal water surface within the limits of 3° and 85°, and by altering the angle between the upper part of the sail plane and the resultant vector of water pressure on the sail, ensuring that $$5 \leqq \beta \leqq 175°.$$

It is expedient to locate the underwater sail at depth $h_1$, which is determimed in the design in relation to the maximum depth $h_2$ of the surface current, within the limits $$1.1 \leqq h_1/h_2 \leqq 100$$

and is regulated by altering the length of cables connecting the sail with the body and/or a module of the floating island and/or alteration of the angle β of the sail's rotation in the vertical plane, by altering the angle between the resultant perpendicular to the surface of the underwater sail and the resultant vector of pressure The floating island's direction of movement is regulated by altering the sail's angle of incidence ϕ in the horizontal plane between 5° and 75° and/or by altering the angle between the resultant vector of water pressure on the underwater sail, and the projected tractive force vector of the connecting junction onto the horizontal plane, within the range of $$0 \leqq \gamma \leqq 85°.$$

In one preferred embodiment of the invention, the floating island comprises a main body (1) (FIG. 1) with underwater and surface sections (2) and (3) respectively, an underwater sail (4) and a connecting junction (5), comprising a system of cables ($\mathbf{5}_1$, $\mathbf{5}_2$, $\mathbf{5}_3$, $\mathbf{5}_4$), connecting the body (1) and the sail (4). The number of cables can be between 1 and 20, depending on the size of the sail and the floating island. A connecting junction consisting of four cables ($\mathbf{5}_1 \ldots \mathbf{5}_4$) is shown on FIG. 1 as an example. The lower ends of the cables ($\mathbf{5}_1 \ldots \mathbf{5}_4$) are fixed around the perimeter of the underwater sail (4), and their upper ends are fixed to the underwater part (2) of the body (1), such that the resultant drag of the cables ($\mathbf{5}_1 \ldots \mathbf{5}_4$) passes through the center (0) of the frontal resistance of the underwater section (2), or its projection onto the horizontal plane. The center (0) of the frontal resistance is the center of gravity of the projected underwater section (2) of the body (1) onto the vertical plane, perpendicular to the direction of the floating island's relative movement.

To ensure the sail (4) occupies a stable vertical position, it is fitted with a load (6) and at least one float (7), primarily located in the upper part of the sail (4). Drop keels (8) are fitted to the underwater section (2) of the body (1), which are capable of rotating about their vertical axis. They thus allow the magnitude, direction and point of application of lateral and frontal resistance to the surface current to be smoothly altered.

Figure 2A:
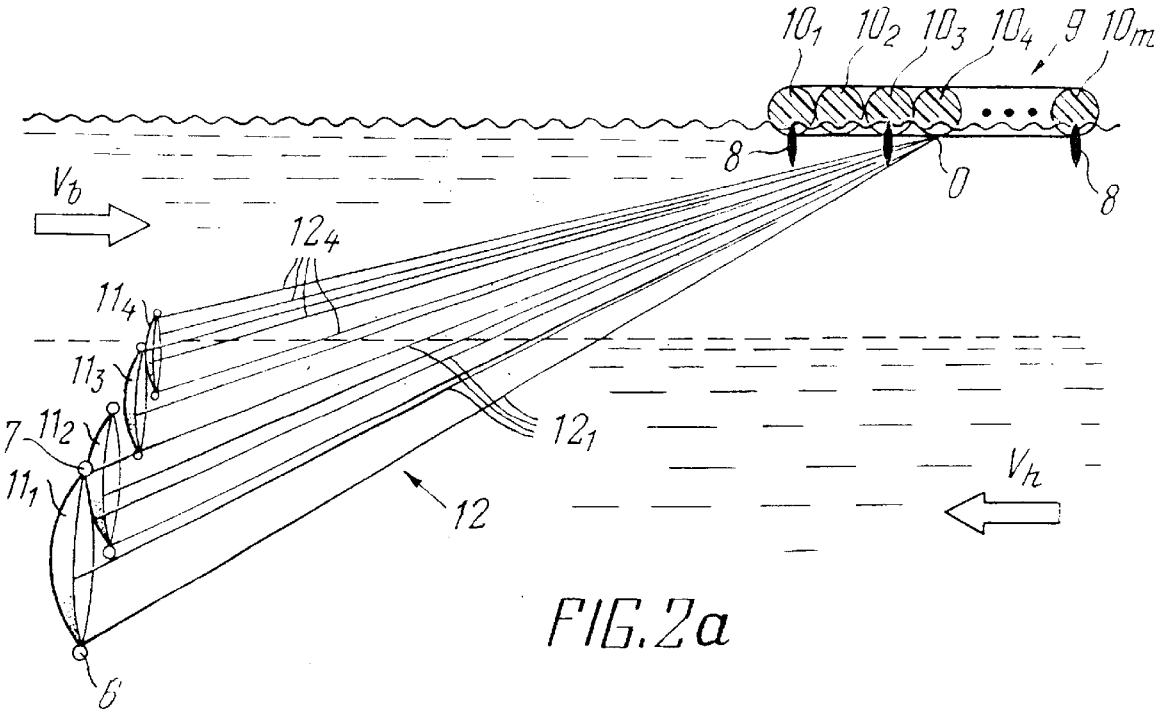
FIG. 2(*a*) is a side elevation view of the floating island with a body consisting of modules, and a group of underwater sails in accordance with the invention.
Figure 2B:
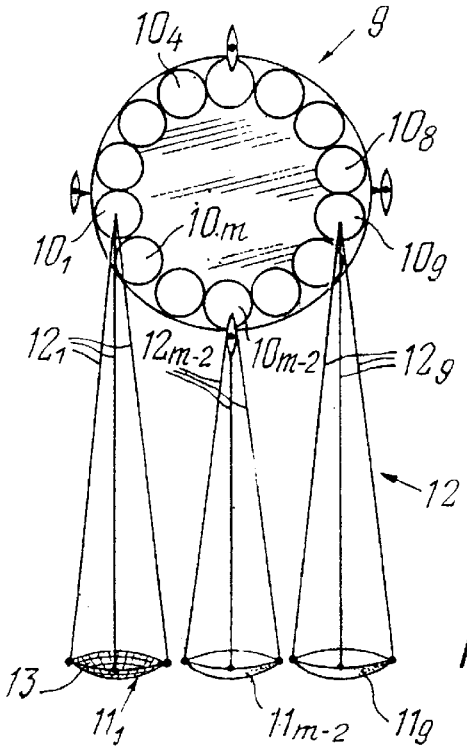

The body (9) (FIG. 2) of the floating island in one preferred embodiment is comprised of m modules ($\mathbf{10}_1 \ldots \mathbf{10}_m$), with positive buoyancy. The modules ($\mathbf{10}_1 \ldots \mathbf{10}_m$) can be various forms of pontoons or platforms made from a range of appropriate materials: foam plastic, foam concrete, metal or plastic. The number m of modules ($\mathbf{10}_1 \ldots \mathbf{10}_m$) is between 2 and $10^{10}$ and is determined by the size and purpose of the floating island. Given a significant number of modules (10), several sails can be deployed (11). As an example, the use of four sails ($\mathbf{11}_1$, $\mathbf{11}_2$, $\mathbf{11}_3$, $\mathbf{11}_4$) is portrayed in FIG. (2*a*), although the number of sails k can be between 1 and $10^{10}$, while each of the sails ($\mathbf{11}_1 \ldots \mathbf{11}_4$) has an individual connecting junction ($\mathbf{12}_1 \ldots \mathbf{12}_4$) respectively. In this case, various ways of connecting the sails ($\mathbf{11}_1 \ldots \mathbf{11}_4$) to the body (9) of the floating island are possible. For example, the cables of connecting junctions ($\mathbf{12}_1 \ldots \mathbf{12}_4$) of all the sails ($\mathbf{11}_1 \ldots \mathbf{11}_4$) are connected to one of the modules ($\mathbf{10}_1 \ldots \mathbf{10}_m$), for example to module $\mathbf{10}_4$, as shown in FIG. (2*a*). However, the sails ($\mathbf{11}_1 \ldots \mathbf{11}_{m-2}$) can be linked to various modules ($\mathbf{10}_1 \ldots \mathbf{10}_9 \ldots \mathbf{10}_{m-2}$), as shown in FIG. (2*b*).

The underwater sail (4) (FIG. 1) or ($\mathbf{11}_1 \ldots \mathbf{11}_4$) (FIG. 2*a*) can take any shape, for example: a circle, a torus, a triangle, a rectangle, an ellipse, a polygon or a trapezoid. It can be rigid, soft or combined, and can be made from any suitable material that ensures a long service life and withstands significant load conditions, for example concrete, stainless steel or synthetic materials.

Alteration of the shape and rigidity of the underwater sail (4) will merely change the number of cables (5) which are used to control it, but will not affect the principle used to control the sail (4). The area of the underwater sail (4) is determined by test in each specific case. It depends on the size of the apparatus, the speed of the countercurrent, the sail's depth of submersion, and the sail shape. Moreover, one of the sails, for example sail ($11_1$), can be made from interconnected parts (13), the area $S_1$ of each of which is determined in relation to the total sail area $S_2$ within the range $$1{,}001 \leqq (S_1+S_2):S_2 \leqq 2.$$

The mass of the float (7) for underwater sails is determined with reference to the optimal angle α (FIG. 3) of the inclination of the system of cables ($5_1$ . . . $5_4$) to create maximum tractive force $F_t$ and is either calculated for each specific case or determined by tests on location.

To augment the ergonomic qualities of the island, where it is to be used as a place where people can live, take vacations or work, the apparatus is to be equipped with a system of directional navigation (14) (FIG. 4). This comprises, for example, a pair of standard lateral impulse thrust units, widely used in shipbuilding, and which can also fulfill the fiction of additional engines (A. V. Vasiliev, V. I. Beloglazov, Ispolzovaniye Podrulivayushikh Ustroistv [The Use of Lateral Thrust Units], pub. Transport, Moscow, 1965, 68 p.). They are placed symmetrically relative to the center of lateral resistance of the en underwater section (2) of the body (1), and are separated to a distance sufficient to create the necessary torque. They are controlled using an automated system based on a magnetic compass or gyrocompass, similar to autopilot systems used in ship navigation and aviation (S. Ya. Beryozin, B. A. Tetyutev Sistemy Avtomatcheskogo Upravleniya Dvizheniyem Sudna po Kursu [Systems of Automatic Control of the Movement of a Ship Along Its Course], Leningrad, 1990, 225 p.). Also, a power source (15) is installed on the body, for example a windmill, solar panels (16), or a sea water desalination apparatus (17). Depending on the size of the floating island, there can be more than one of the devices (15 and 17) listed above.

Each of the connecting junction cables (5) (FIG. 1), (12) (FIG. 2*b*) are connected by their upper ends to a device (18) (FIG. 5) for altering the length of cables. This could be a winch, using automated control units (19) installed at the center (0) of frontal resistance and intended to effect control, by both simultaneously or separately easing off or picking up cables. The winches are installed on the working deck of the body (1). The connection of decks (4) (FIG. 1), ($11_1$ . . . . $11_4$) (FIG. 2*a*), to the floating island by the method described above makes it possible to avoid the undesirable torque of the body (1) (FIG. 1) or (9) (FIG. 2*a*) about its vertical axis.

The sail (4) (FIG. 1) or one of the sails ($11_1$ . . . $11_4$) (FIG. 2*a*) can be fitted with a power source unit (20) (FIG. 4), such as a hydroelectric power unit, working on a mechanical, hydraulic mechanical, or other principle.

The method of controlling the floating island is as follows. The depth $h_1$ (FIG. 3) is the depth of submersion of the underwater sail (4). It is determined by the depth h (the border of the lower part of the countercurrent) and the depth $h_2$ (the upper border of the lower countercurrent). The depth $h_1$ is regulated by altering the length of the system of connecting cables (5) where the mass of the sail itself (4) is constant and/or by altering of the angle β of the sail (4) rotation in the vertical plane.

The sail (4) (FIG. 3) is controlled as follows.

Step 1. Drawing in, for example, cable $5_1$ of the connecting junction (5) and easing off cable $5_4$, the angle β of the sail rotation in the vertical plane is decreased to the magnitude $\beta_1$ and a lifting force is generated at the sail (4); the sail is lifted up. Conversely, by easing off cable ($5_1$) and drawing in cable ($5_4$), the angle of sail rotation β is increased to the magnitude $\beta_2$. This forces the sail (4) to move down, in other words controlling the depth $h_1$ of the sail's (4) submersion, without altering the length of the system of cables ($5_1$ . . . $5_4$).

Step 2. In order to increase or decrease the depth $h_1$ of sail (4) submersion, the length of the system of connecting cables ($5_1$ . . . $5_4$) is correspondingly increased or decreased, without altering the angle α, in other words leaving it at the optimal magnitude for the given sail mass.

Step 3. Similarly, the corresponding cables of the connecting junctions (12) are used to alter the angle ϕ (FIG. 4) of sail (11) rotation in the horizontal plane, forcing the sail (11) to move to the left and right, where the maximum magnitude of the angle ϕ is 175°, and the minimum angle is −5°.

Figure 3:
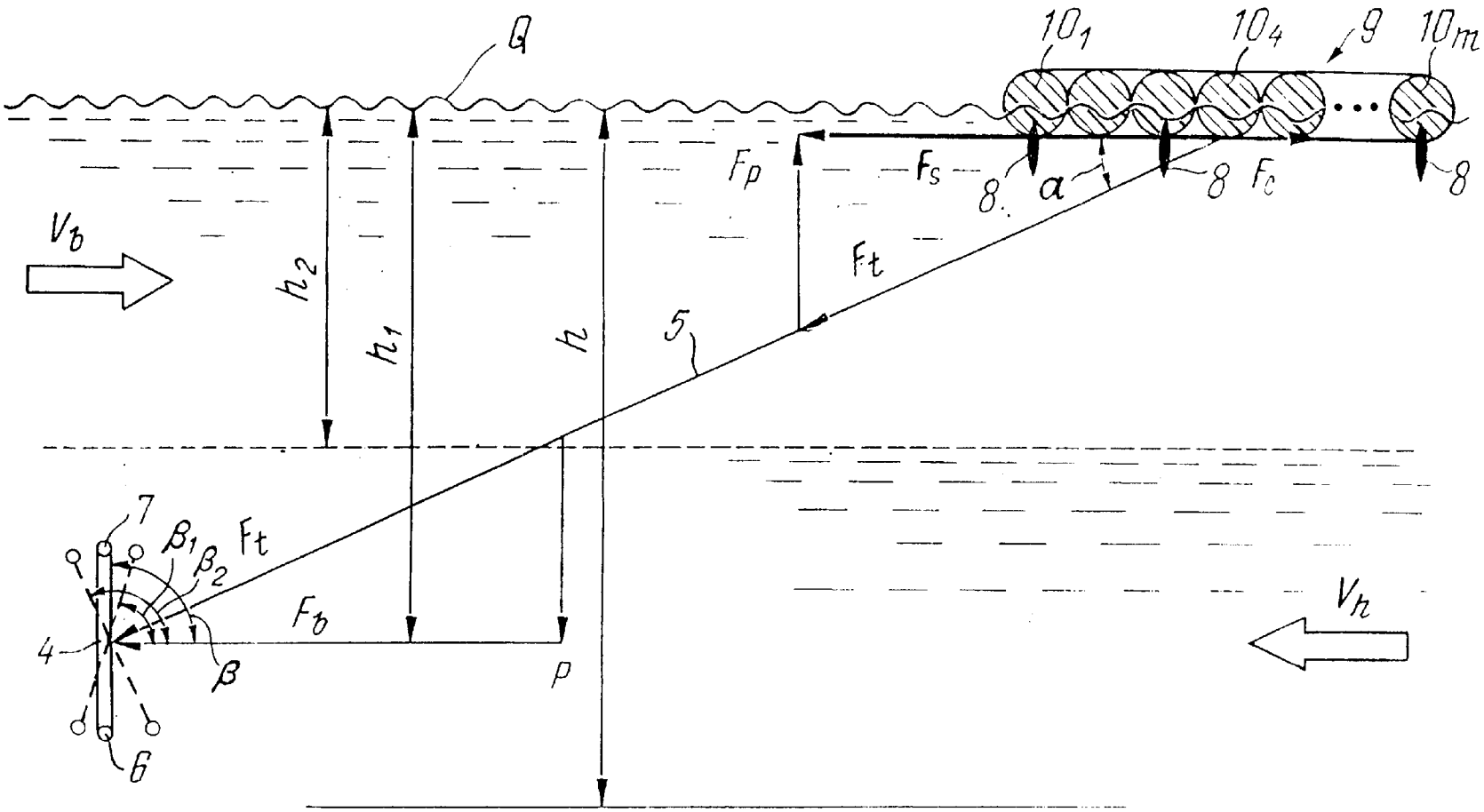
FIG. 3 is a diagram illustrating the principle by which the movement of the floating island is controlled.

FIG. 3 is a schematic of how the underwater sail (4) functions, as projected onto the vertical plane. The force of a current pushes a certain mass of water against the sail with force $F_b$, aimed in the direction of the current, and moving with speed $V_h$. Tractive force $F_t$ acts at the system of cables (5), directed along the cables (5) at an angle a to the surface of the ocean Q. In the triangle of forces $F_t$, F*b* and P, where P is the force of the sail's (4) mass, it is clear that $$F_t=F_b: \text{COS } \alpha.$$

In the triangle of forces $F_t$, $F_p$, ($F_s$+$F_c$) it is clear that $$F_s=F_t \times \text{Cos } \alpha - F_c, \qquad \text{Formula [1]}$$

where: $F_t$ is the force of resistance at a depth $h_2$ to the movement of the floating island against the surface current; $F_s$ is the resultant force vector of the movement of the floating island; $F_p$ is the resultant force vector of the buoyancy of the floating island, offsetting the gravitational pull of the connecting junction and underwater sail system.

It follows from formula [1] that where Cos α=const, $F_c$=const, the resultant force vector $F_s$ of floating island movement will move the island against the surface current, if $F_s=F_t' \times \text{Cos } \alpha - F_c > F_q$, where the speed of such movement cannot exceed the speed $V_h$ of the lower countercurrent.

If $F_s=F_t \times \text{Cos } \alpha - F_s + F_c$, then the floating island will hold its position motionless. If $F_s=F_t \times \text{Cos } \alpha - F_c < F_c$, then the floating island will drift along the surface current. This specific case is portrayed in figure (4*a*), where a diagram shows how the floating island operates, but on the view from above, the upper and lower currents are horizontal and directed at an angle of 180° to each other, where the angle ϕ of rotation of the underwater sail (11) in the horizontal plane can not be less than 5°.

Figure 4A:
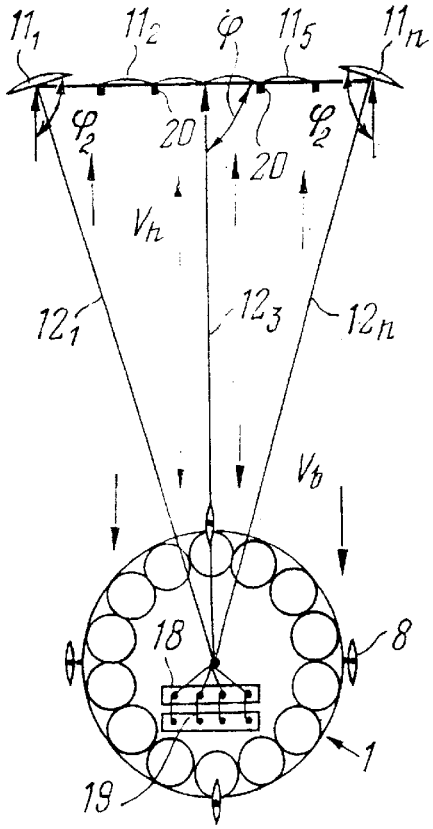
FIG. 4(*a*) is a top plan view of the floating island of FIG. 3.
Figure 4B:
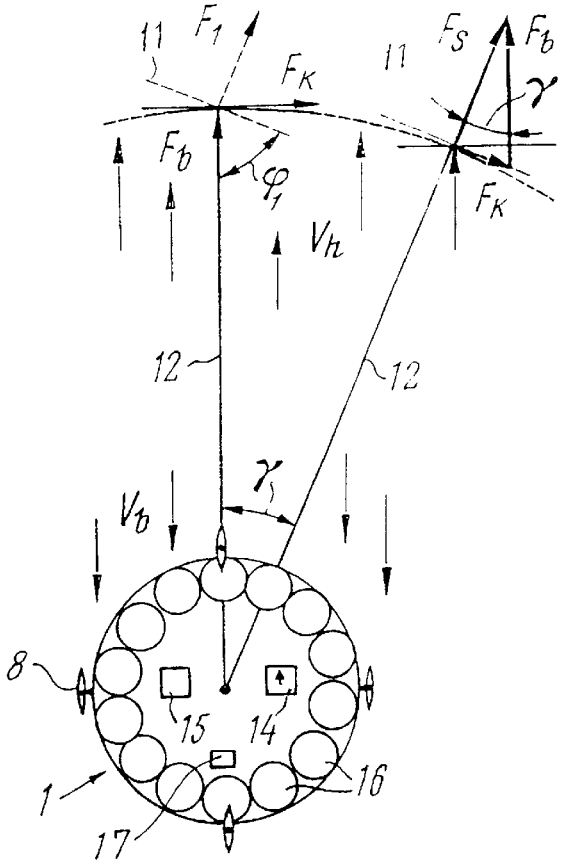

FIG. 4*b* shows an example of the movement of the floating island, where the upper and lower currents are horizontal, but the angle (ϕ of the sail's (11) rotation in the horizontal plane is less than 90°. Changing the angle ϕ from the initial position to $\phi_1$, one can alter the direction of the reactive force to the pressure of water, by turning the sail (11) in the horizontal plane, and generating the force $F_k$, directed at a tangent to a circle with radius equal to the projection of the system of cables onto the horizontal plane. This moves the sail to the right, depending on the direction of the sail's (11) rotation, and pulls the floating island behind it. Under the action of the force $F_k$, the sail moves to the right relative to the countercurrent directional vector, until equilibrium is established between the force $F_k$ (moving the sail to the right) and the reactive force to resistance at the cable system and the sail itself to water resistance, which pushes the sail and cables to the left, and the entire floating island system will be located in equilibrium and move to the right across the surface current.

FIG. 4*a* shows an example of controlling the floating island by altering $F_t$ by two underwater sails (11$_1$) and (11$_n$), located symmetrically relative to the point of application of $F_t$. Such a system functions according to the principle of sluices in river dams, releasing excess water and in this way reducing the water pressure level.

FIG. 4*a* shows an example of controlling the magnitude of $F_t$ and altering the electric load at the hydroelectric generators or either reducing or increasing the interval of hydroelectric generator vanes, which also changes the amount of electrical energy produced. As can be seen from the above description, it is always possible to determine parameters such as to place the floating island in a specified state (movement or holding a position at certain coordinates). These parameters include the length of the cable system (5), the angles $\alpha$, $\beta$, $\phi$ and the angle of incidence $\ominus$ in the horizontal and vertical planes. The parameters can be set to combinations where the floating island—as an entire system—will attain equilibrium itself, and maintain that state indefinitely.

Thus the proposed floating island, once deployed in the equatorial zone of the Pacific Ocean or any other location with similar conditions, utilizes the energy of countercurrents below the surface for its own movement, thereby providing as an ideal location for people to either work or take vacations.

INDUSTRIAL APPLICATIONS

The invention, in the form of drifting and immobile surface islands, could be successfully used for various forms of scientific research, providing a base for monitoring, research and rescue services, or as sea vacation resorts, or as a comfortable home in the ocean.

What is claimed is:

1. A floating island for enabling control of its movement or stability on the surface of water which flows in a given direction and in which the surface overlies a underwater current flow in an other direction at an angle with respect to the given direction, the floating island comprising a main body (1,9) having underwater and surface sections (2,3) of positive buoyancy, an underwater sail (4) having at least one side with a frontal area, a system of cables (5$_1$. 5$_2$. 5$_3$. 5$_4$.) which connect the sail with the underwater section (2), the cables positioning the sail so that the frontal area of its one side is at a lateral angle with respect to the given direction of the underwater current, the lateral angle being sufficient to cause said underwater current flow to impact against the frontal area with a force having a magnitude F that is transmitted from the sail through the system of cables to the floating island, and means for varying the lateral angle of the one side with respect to the given direction sufficient to vary the magnitude of force F to cause either movent of the floating island in a desired direction on the surface or maintaining its stability with respect to the water.

2. The floating island of claim 1, and further comprising at least one additional underwater sail (11$_2$ . . . 11$_4$) with an individual connecting junction (12$_2$ . . . 12$_4$) to connect it to the underwater (2) section of the body (9).

3. The floating island of claim 1 and further comprising at least one of the underwater sails (11$_1$) is made to be a constituent part of several interconnected parts (13).

4. The floating island of claim 3 in which the minimal area $S_1$ of each section (13) of the underwater sail (11$_1$) is determined in relation to the area $S_2$ of the underwater sail (11$_1$) within the range $1.001 \leqq (S_1+S_2):S_2 \leqq 2$.

5. The floating island of claim 1 in which the total number (k) of underwater sails (11$_1$) and/or their interconnected parts (13) is within the range $1 \leqq k \leqq \mathbf{10}^{10}$.

6. The floating island of claim 1 and further comprising drop keels (8), installed on the underwater section (2) of the body (1), such that they can be rotated about their vertical axis.

7. The floating island of claim 1 in which each underwater sail (4) is fitted with at least one attached float (7).

8. The floating island of claim 7 and further comprising a float (7) which is attached to the upper part of the underwater sail (4).

9. The floating island of claim 1 which further comprises a system of directional navigation (14), fitted at the surface section (3) of the body (1).

10. The floating island of claim 1 in which at least one power source (15) is fitted on the body (1).

11. The floating island of claim 1 in which at least one solar panel (16) is fitted on the body.

12. The floating island of claim 1 in which at least one water desalination apparatus (17) is fitted to the body (1).

13. The floating island of claim 1 in which the body is fitted with a device (18) for altering the length and rotation of the connecting junction cables (5, 12) and an automated system for controlling the device (18).

14. The floating island of claim 1 in which at least one power source (20) is installed on the underwater sail (11$_1$ . . . 11$_n$).

15. The floating island of claim 1 in which the underwater sail (4) has a shape selected from the group consisting of circle, torus, triangle, rectangle, polygon, trapezoid and ellipse.

16. The floating island of claim 1 in which the underwater sail (4) is made from a material which ensures a long service life and which withstands significant loads.

* * * * *